US007086810B2

(12) United States Patent
Masetti et al.

(10) Patent No.: US 7,086,810 B2
(45) Date of Patent: Aug. 8, 2006

(54) FLOATING STRUCTURE

(75) Inventors: Isaias Quaresma Masetti, Rio de Janeiro (BR); Ana Paula dos Santos Costa, Rio de Janeiro (BR); Kazuo Nishimoto, São Paulo (BR)

(73) Assignee: Petróleo Brasileiro S.A. - Petrobras, Rio de Janeiro (BR)

( * ) Notice: Subject to any disclaimer, the term of this patent is extended or adjusted under 35 U.S.C. 154(b) by 0 days.

(21) Appl. No.: 10/932,250

(22) Filed: Sep. 2, 2004

(65) Prior Publication Data

US 2006/0045628 A1 Mar. 2, 2006

(51) Int. Cl.
*B63B 35/44* (2006.01)

(52) U.S. Cl. ..... 405/224; 405/223.1; 405/205; 114/164; 114/256

(58) Field of Classification Search ..... 405/203, 405/200, 204, 205, 223.1, 224.2, 224; 114/256, 114/264–266
See application file for complete search history.

(56) References Cited

U.S. PATENT DOCUMENTS

| | | | | | |
|---|---|---|---|---|---|
| 3,408,821 | A | * | 11/1968 | Redshaw | 405/200 |
| 3,472,032 | A | * | 10/1969 | Howard | 405/210 |
| 3,921,558 | A | * | 11/1975 | Redshaw | 114/256 |
| 4,048,943 | A | * | 9/1977 | Gerwick, Jr. | 114/256 |
| 4,473,323 | A | * | 9/1984 | Gregory | 405/224.4 |
| 4,606,673 | A | * | 8/1986 | Daniell | 405/210 |
| 5,609,442 | A | * | 3/1997 | Horton | 405/205 |
| 6,113,314 | A | * | 9/2000 | Campbell | 405/223.1 |
| 6,340,272 | B1 | * | 1/2002 | Runge et al. | 405/203 |
| 6,371,697 | B1 | * | 4/2002 | Huang et al. | 405/224.2 |

FOREIGN PATENT DOCUMENTS

| | | | | |
|---|---|---|---|---|
| JP | 6-56074 | * | 3/1994 | 114/264 |
| WO | WO 02/090177 A1 | | 11/2002 | |

* cited by examiner

*Primary Examiner*—Frederick L. Lagman
(74) *Attorney, Agent, or Firm*—Sughrue Mion, PLLC

(57) ABSTRACT

The present invention relates to a floating structure to receive maritime production or drilling installations that is provided with means to reduce movement caused by the action of environmental forces on it. These means confer a more stable behavior on the structure's movements.

7 Claims, 7 Drawing Sheets

FLOATING STRUCTURE

The present application is based on Brazilian Application No. PI 0300265-9, filed on Jan. 31, 2003, the entire contents of which are incorporated herein by reference.

FIELD OF THE INVENTION

The present invention relates to a floating structure for maritime production or drilling installations, especially applicable for the exploitation of deep and ultra-deep waters. More particularly, the present patent application relates to a floating structure adequate to the exploitation of petroleum in deep and ultra-deep waters that may be provided with means for the storage of oil.

BACKGROUND OF THE INVENTION

With the discovery of fields producing hydrocarbons located in the sea at ever-greater depths the utilization of rigid structures fixed to the seabed to support production installations has become more and more costly.

Consequently, the use of floating structures (better known among specialists as Stationary Production Units—SPUs to receive production installations has been emerging as an ever more-frequent alternative that normally presents a lower cost than fixed structures.

These Stationary Production Units (SPUs) are connected to ascending fluid production and export tubes also known among specialists by their English language designation as "risers." Risers conduct the production of producing wells to the SPU, or link the SPU to other installations that receive the production of the fluids produced.

These Stationary Production Units (SPUs) must have such characteristics as to allow the utilization of ascending fluid production and export tubes ("risers") in catenary curves made of steel, also known among specialists by the English language abbreviation "SCR," derived from "steel catenary risers."

These steel catenary riser tubes (SCRs) present a lower manufacturing and installation cost in comparison to the flexible riser tubes used to that point. Furthermore, in the case of production at greater depths, they lighter, which reduces the load to be supported by the floating structure.

Frequently the economic feasibility of an enterprise for the exploitation of hydrocarbon-producing maritime field depends upon the reduction of total installation and operation costs. Specialists have proposed new Stationary Production Unit (SPU) shells to meet this requirement.

Significant technological innovations have emerged in recent years in anchoring systems and in ascending fluid production and export tube ("riser") systems. Such innovations, however, have been applied to conventional structures, such as semi-submersible platforms and tanker ships in the majority of cases, or to a few structures of a monocolumnar type of enormous draft, known to the specialists as a SPAR type platform, or else to platforms with far-reaching legs, known as TLP type platforms.

Semi-submersible platforms have the principal characteristic, in addition to being anchored, of remaining in a substantially stable position, presenting small movements when they suffer the action environmental forces such as the wind, waves and currents.

This type of floating structure has some disadvantages to being utilized as an SPU. An outstanding disadvantage is its limited load-bearing capacity, which often limits the use of equipment in processing plants installed on the platform deck. Another is a low storage capacity for storing the oil that comes on board, also arising from the limited load-bearing capacity.

Another problem to be noted is the fact that the hull of semi-submersible platforms are structures that are difficult to manufacture, and require techniques different from those employed in ship construction. This type of floating structure also has difficulty in absorbing variations in the load on deck that arise from project changes, which results in a great disadvantage in its use.

Project alterations arise from necessities that emerge during the development of a project, and from employing more equipment in the processing plant as the result of re-evaluation of the production capacity of the field producing the petroleum where the floating structure will be employed.

The use of tanker ships adapted to receive a production plant on their deck has become quite common in recent years, specifically due to the great availability of this type of floating structure on the market. The great advantages presented by such ships are their great capacity to receive loads and their great capacity for storage.

Tanker ships, however, have the disadvantage of not being axi-symmetrical structures and the load on the ship's structure is going to vary in function of the locations where the various items of production equipment are mounted.

The great disadvantage in using a ship to house a production plant on its deck is related to the difficulties that this type of floating structure presents to operating in a stabilized manner in relation to environmental conditions, i.e., winds, waves and marine currents.

For ships to be able to receive ascending fluid production and export tubes in a stable manner, i.e., without significant movements in such tubes, it is very common to employ a rotational structure in the ship that is provided with a body anchored to the seabed. That body remains in a substantially fixed position in relation to the seabed, presenting quite limited movements.

The aforesaid body is provided with roller bearings that are fixed to the ship, about which the ship may rotate on the rotational axis of the fixed body. The fluid production and export tubes are connected to the aforesaid body and the body is provided with rotational connections that allow the fluids to flow through to the production plant installed on the deck of the ship.

This type of rotating structure is known among marine oil field technicians by its English language nomenclature: "turret." The turret is installed in an existing internal opening in the hull of the ship, also known among the technicians by its English language nomenclature: "moonpool."

This type of arrangement presents the disadvantages of being very expensive and requiring great care in its operation. Furthermore, the dynamic impediments in the rotating connections are a constant concern, since a possible gas leak at that point would endanger the entire installation.

Also known are some structural concepts derived from SPAR and TLP type platforms, about which very little is known of any actual use since, in order to be utilized as alternatives for production in deep waters they still require the implementation of exhaustive studies and the execution of the corresponding engineering project.

The SPAR type platform, which refers to a projected floating type structure projected to undergo few movements, presents the inconvenience of being provided with an extremely deep draft, about 150 meters, along with the fact that varying its draft is impossible.

The great disadvantage of the SPAR type platform is related to the fact that its extremely deep draft makes it impossible to transport the platform with the deck for installation of the equipment in place. It is therefore necessary to carry out the mounting of the deck in the open sea, which requires the use of various maritime support vessels, all quite sophisticated and of an elevated operational cost.

Document WO 02/090177, published Nov. 14, 2002, appended hereto for reference, describes a type of floating structure that includes an axi-symmetrical platform cylindrical or polygonal in shape, with a flat bottom. This floating structure is provided with peripheral indentation in its lower, submerged part, and the possibility of storing oil inside the structure is projected.

The basic function of the lower peripheral indentation, as described in Document WO 02/090177, is to endow the floating structure with a capacity to attenuate the effects that waves exercise on it. The peripheral indentation may be provided with deflecting and perforated plates to increase the attenuation effect against the force of the waves.

The floating structure described in Document WO 02/090177 may also be provided with an internal opening ("moonpool") to receive ascending fluid production and export tubes ("risers") or with the drilling column of a deep-sea drilling line or probe, with all its complementary equipment.

The great advantage provided by this type of structure lies in its tremendous capacity to receive a load, associated with the fact that it is a floating structure with minimal movements, something that facilitates production and drilling operations.

Although the description of the floating structure set forth in Document WO 02/090177 does not allow us to conclude with certainty, it appears that the floating structure is quite large, with a tremendous displacement, in order to operate in an adequate manner.

The present invention relates to a floating structure for the reception of production and/or drilling installations on its deck so as to resolve all the problems related above.

BRIEF DESCRIPTION OF THE DRAWINGS

The invention will be described below in reference to the appended FIGURES, which are an integral part of the present report and, merely by way of example, portray a preferred concrete example of the implementation of the invention.

DESCRIPTION OF PREFERRED REALIZATIONS

Figure 1:
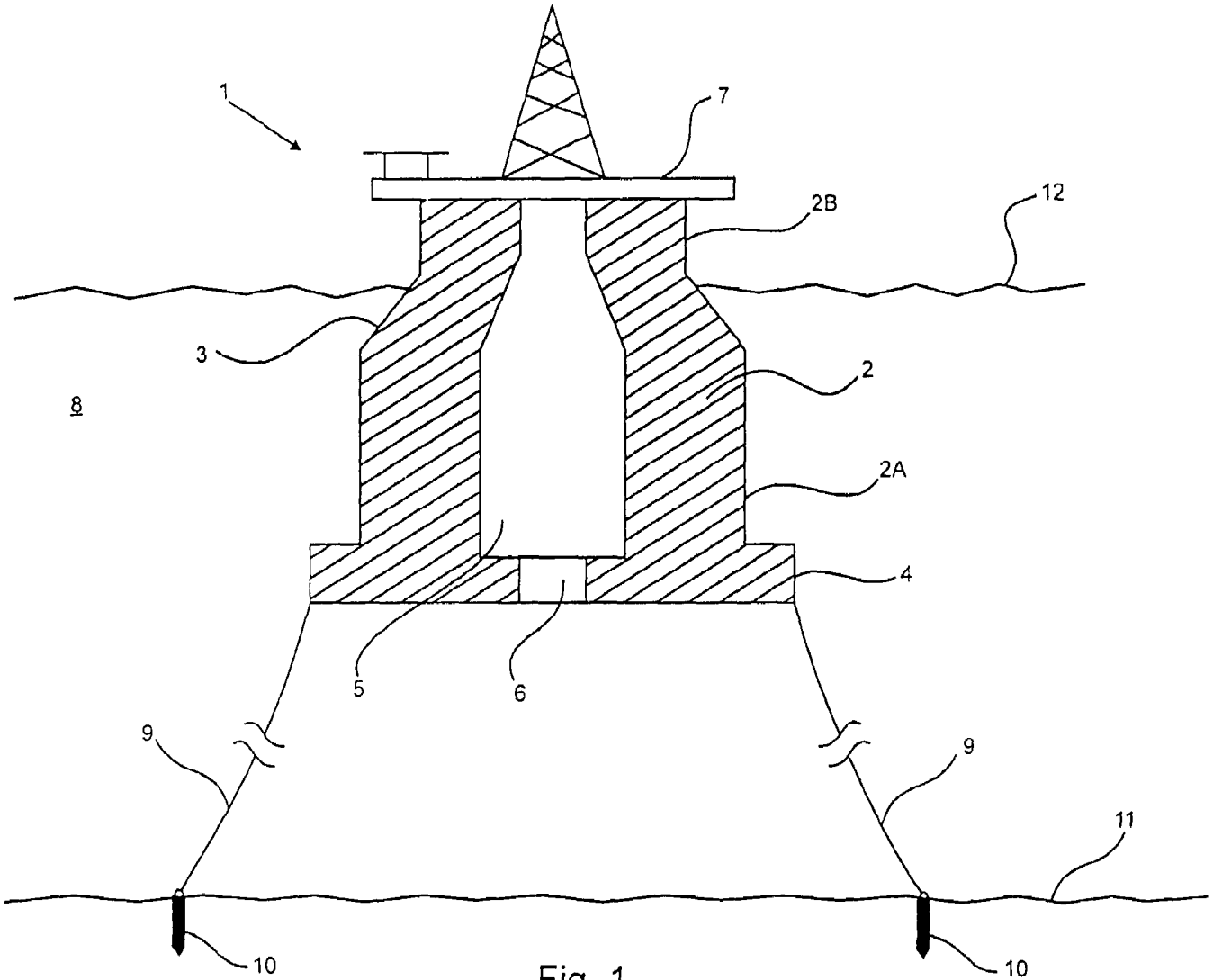
FIG. 1 is a lateral view of a cross section of the floating structure the object of the present invention.
Figure 2A:
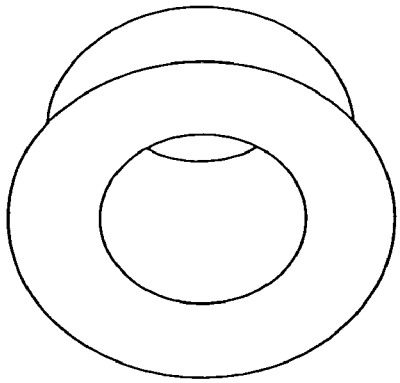
FIGS. 2A, 2B and 2C, show perspective views of the floating structure the object of the present invention.
Figure 2B:
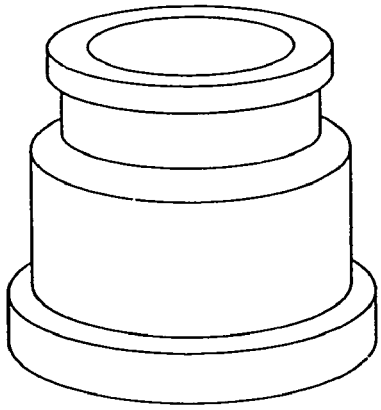
Figure 2C:
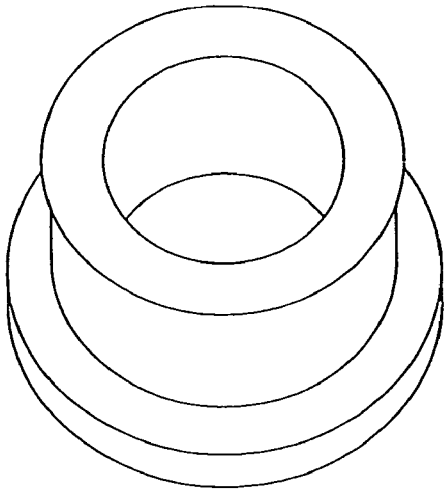

FIG. 1 shows a floating structure or hull (1), which floats on a body of water (9) in the sea. The floating structure (1) is fixed to the seabed (11) by means of anchoring lines (9), which are connected to attachment arrangements (10) properly fixed in the seabed (11) by means of known techniques.

The floating structure (1) is made up of an axi-symmetrical body (2), which has a lower submerged portion (2A) and an upper, above the water portion (2B). In the FIG. 1 a deck (7) may be observed which is located on the highest point of the above the water portion (2B), which is provided with all the installations necessary for the operation of Stationary Production and/or Drilling Unit (SPU). The submerged portion (2A) is provided, in its lower part with a lower peripheral salience or skirt (4).

The dimensions of the lower, underwater part (2A) are greater than the external dimensions of the upper, emergent part (2B) and between these two parts (2A) and (2B) there is a sloping, inclined transition area or bank (3).

The body (2) is provided internally with an internal empty space ("moonpool") (5), and it has the function, among others, of receiving the ascending production and export tubes of the fluids produced (not shown in the FIGURES).

The external and internal perimeter of each one of the lower submerged parts (2A) and of the upper, emergent part (2B) may be cylindrical or polygonal, depending upon the convenience of manufacture.

The present invention is provided with several characteristics that allow it to substantially reduce the movements of the floating structure (1) caused by the restless motion of the sea (waves, currents). It therefore exhibits better performance than that of a semi-submergible platform, as may be seen from the following.

The first characteristic reducing the movements of the floating structure (1) is related to the function of the inclined transition portion (3) of the floating structure (1).

The floating structure (1) is provided with arrangements to guarantee that the waterline (12) is always located on the inclined transition portion (3) which, due to its inclination, causes an alteration in the hydrodynamic forces arising from waves that act on the floating structure (1) absorbing the shock of the impact of waves on the floating structure (1) as a consequence.

Arrangements to guarantee that the waterline (12) is always located on the inclined transition portion (3) of the floating structure (1) might include ballast tanks and a ballast management system.

The second characteristic reducing the movements of the floating structure (1) is related to the function of the lower peripheral salience or skirt (4) on the floating structure (1).

The lower peripheral skirt (4) acts as a stabilizer of the movements of the floating structure (1). Since it conforms to the floating structure (1), if it is moved as a result of waves and currents, the lower peripheral salience (4) will always tend to retain a mass of water on top of it, thus generating a shock absorbing forces opposed to such movements of the floating structure (1).

The third characteristic reducing the movements of the floating structure (1) is related to the function of an internal empty space (5) in the floating structure (1) that has peculiar characteristics.

As may be seen in the FIG. 1 internal empty space (5) in the floating structure (1) is provided with a lower opening (6) in its lower part that has a smaller diameter than the lower part of the internal empty space (5). Therefore, as the floating structure (1) is displaced vertically upward as the result of wave and/or current movements, the lower opening (6) will tend to create difficulties for the mass of water above it in the inside of the internal empty space (5) to be able to exit from the inside of the internal empty space (5), which will tend to absorb the shock of that vertical rising movement.

When the contrary movement occurs in which the floating structure (1) is displaced vertically downward as the result of wave and/or current movements, the lower opening (6) will tend to create difficulties for the entrance of the mass of water below it attempting to enter the internal empty space (5) which tends to absorb the shock of that vertical dropping movement.

Thus the internal empty space (5) and its smaller lower opening (6) act as a means to limit the movements of the floating structure (1) and they always operate in the opposite direction to the movements attributable to currents and waves. This increases the natural period of the floating structure (1) and therefore substantially reduces its vertical motion.

The floating structure (1) is provided with ballast tanks located in a compartmented manner in the lower submersible portion (2A) and the upper emergent part (2B) and may also be provided with storage tanks to receive the production of petroleum wells.

The floating structure (1) object of the present invention presents a series of advantages in its operation in comparison with the floating structures presently known in the art, as listed below.

Due to its great stability, the floating structure (1) object of the present invention allows the ascending production tubes ("risers") to be connected directly to the structure without the necessity to use intermediary buoys to absorb part of the movements to which the risers are subjected when employed with the floating structures presently known in the art.

In function of the characteristics of its axi-symmetrical shape, the floating structure (1) may be constructed in modules that would then be brought together in a shipyard. Construction of the floating structure (1) could therefore be performed in medium-size shipyards, employing the same techniques as used for ship construction, thereby considerably reducing its cost.

Also in function of the characteristics of its axi-symmetrical shape, the majority of the inspections required during the manufacture of the floating structure (1) would be performed on similar regions of each of its modules, as opposed to what occurs in a ship or a semi-submersible under construction, which facilitates the activity considerably.

Although FIG. 1 has shown a floating structure (1) with anchoring lines (9) connected to the lowest part of the lower submersible portion (2A), that arrangement is not mandatory, since there is no impediment whatsoever to such anchoring lines being connected to the floating structure (1) at the lower submersible portion (2A) and/or at the upper emergent part (2B), or there may be a combination of both possibilities.

Figure 5:
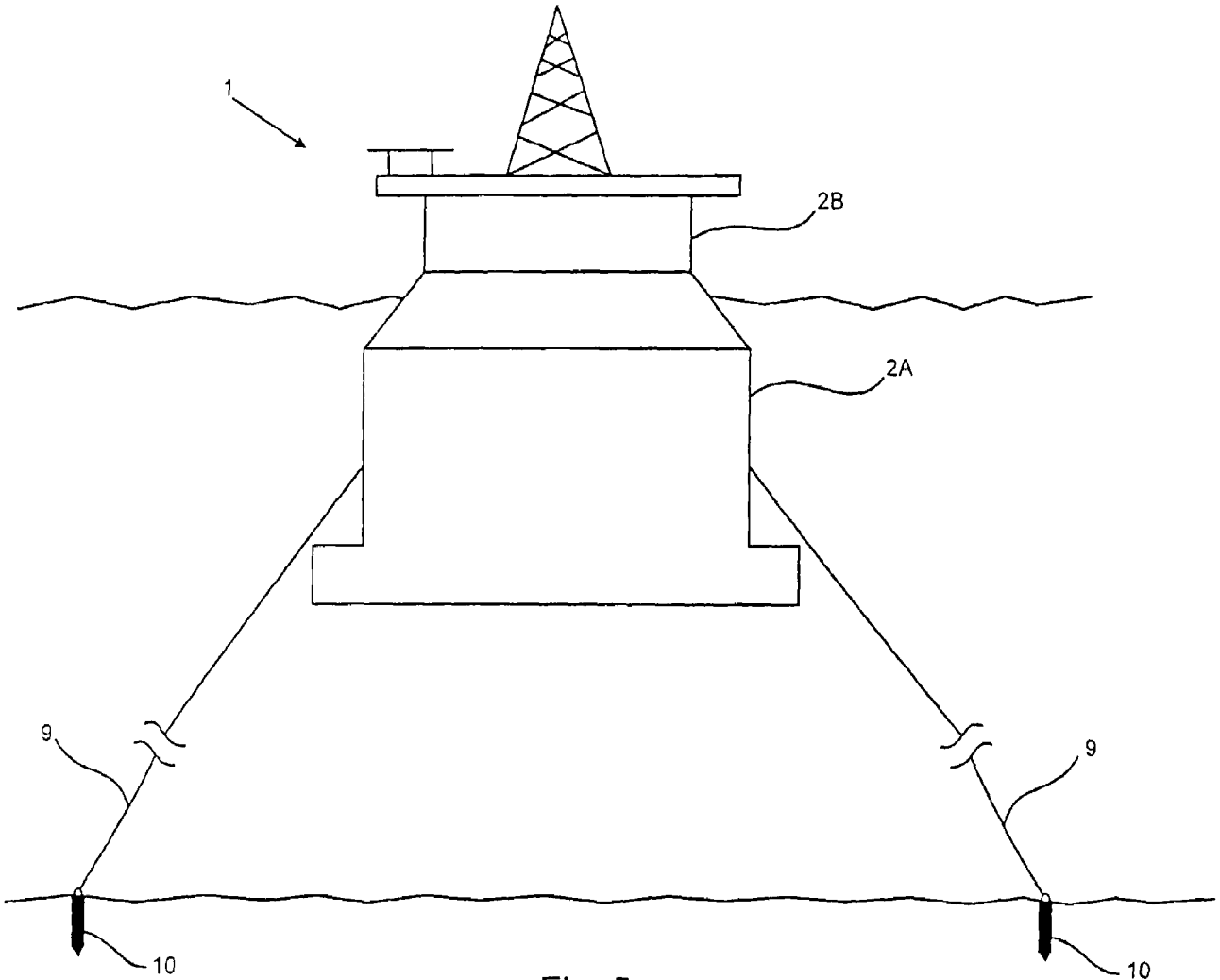
FIGS. 5, 6 and 7 show frontal views of such floating structures.

FIG. 5 shows a situation in which a floating structure (1) in accordance with the present invention is anchored to the sea bottom by means of anchoring lines (9) connected to the lateral flank of the lower submersible portion (2A).

Figure 6:
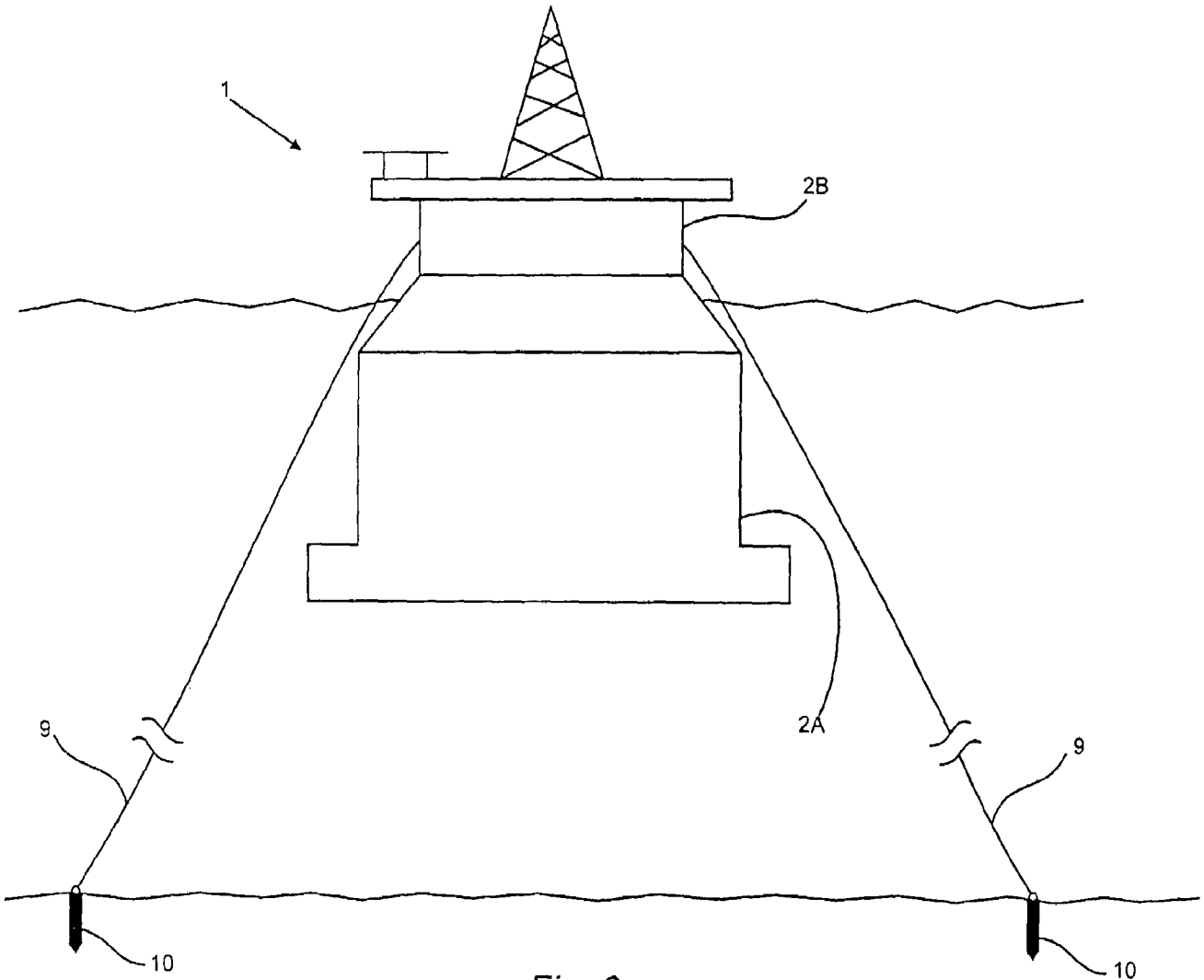

FIG. 6 shows a situation in which a floating structure (1) in accordance with the present invention is anchored to the sea bottom by means of anchoring lines (9) connected to the lateral flank of the upper emergent part (2B).

Figure 7:
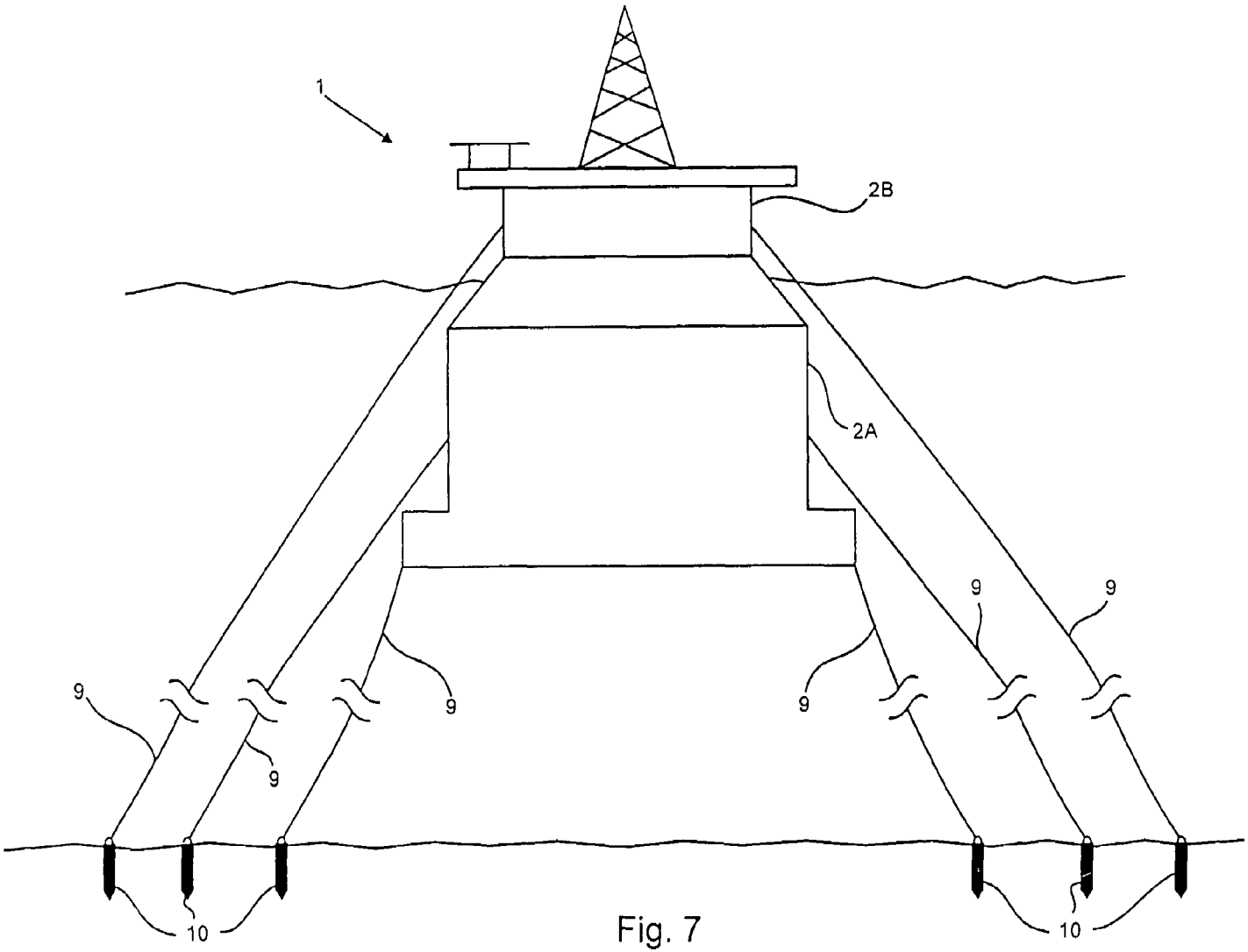

FIG. 7 shows a situation in which a floating structure (1) in accordance with the present invention is anchored to the sea bottom by means of anchoring lines (9) connected to various positions on the lower submersible portion (2A) and on the upper emergent portion (2B).

The ascending production and export tubes for fluids produced may, in the same way as has been mentioned for the anchoring lines, pass through the interior of the internal empty space (5), be connected to the floating structure (1) in the lower submersible portion (2A) or in upper emergent part (2B), or there may be a combination of both possibilities.

The floating structure (1) must be planned in such a manner as to include various thrust and ballast chambers projected in such a way as to confer sufficient stability to support progressive flooding so as to eliminate the risk of sinking due to possible damage.

An important characteristic of the floating structure (1) object of the present invention is that it provides structural characteristics to reduce areas sensitive to fatigue, i.e., there are no structural connections that tend to concentrate forces as there are, for example, in submersible platforms.

Figure 3:
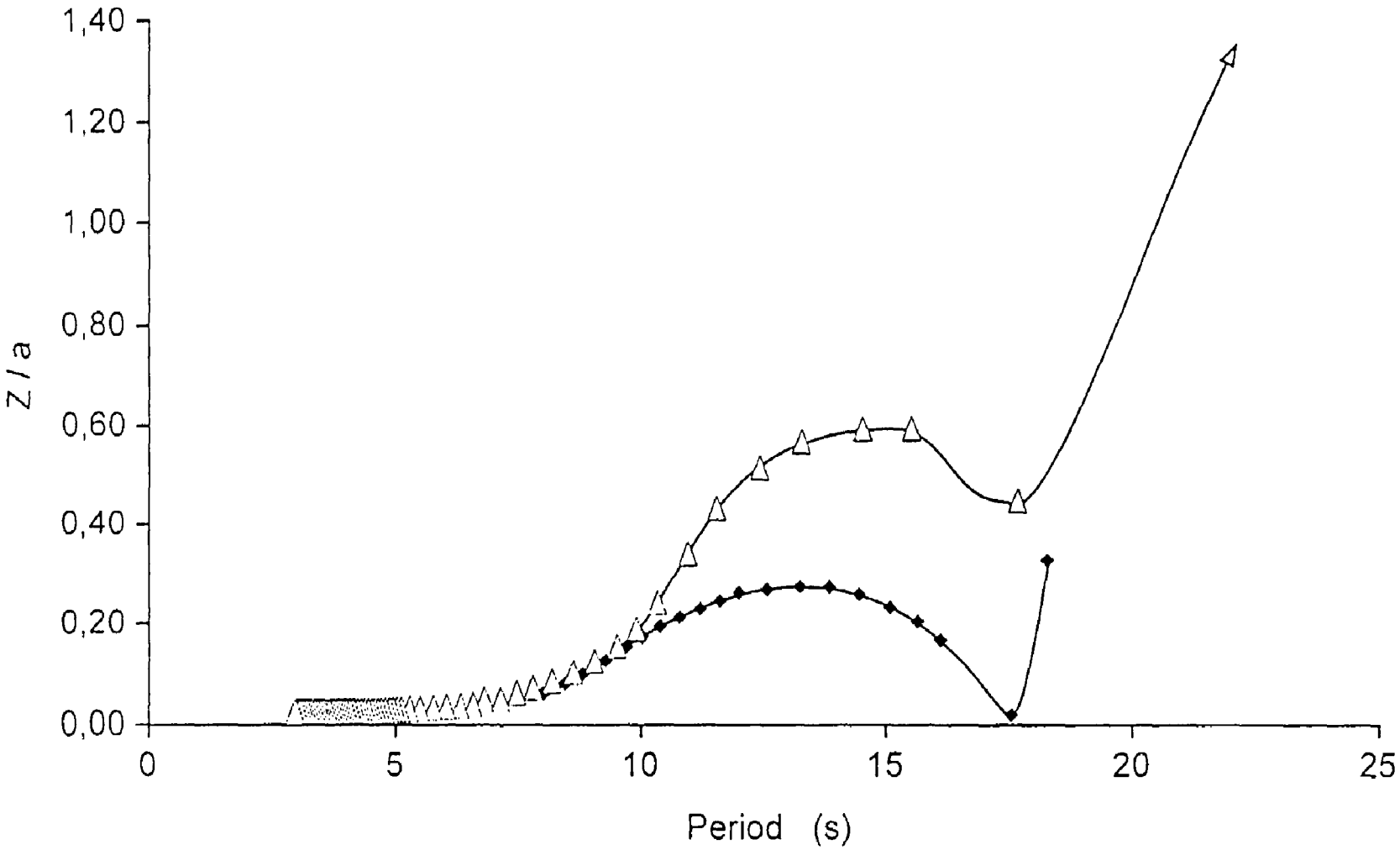
FIG. 3 shows a curve comparing the vertical oscillation movement ("heave") of a semi-submersible platform and the floating structure the object of the present invention.

FIG. 3 shows a curve comparing the vertical oscillation movement ("heave") of a semi-submersible platform and the floating structure (1) the object of the present invention.

Figure 4:
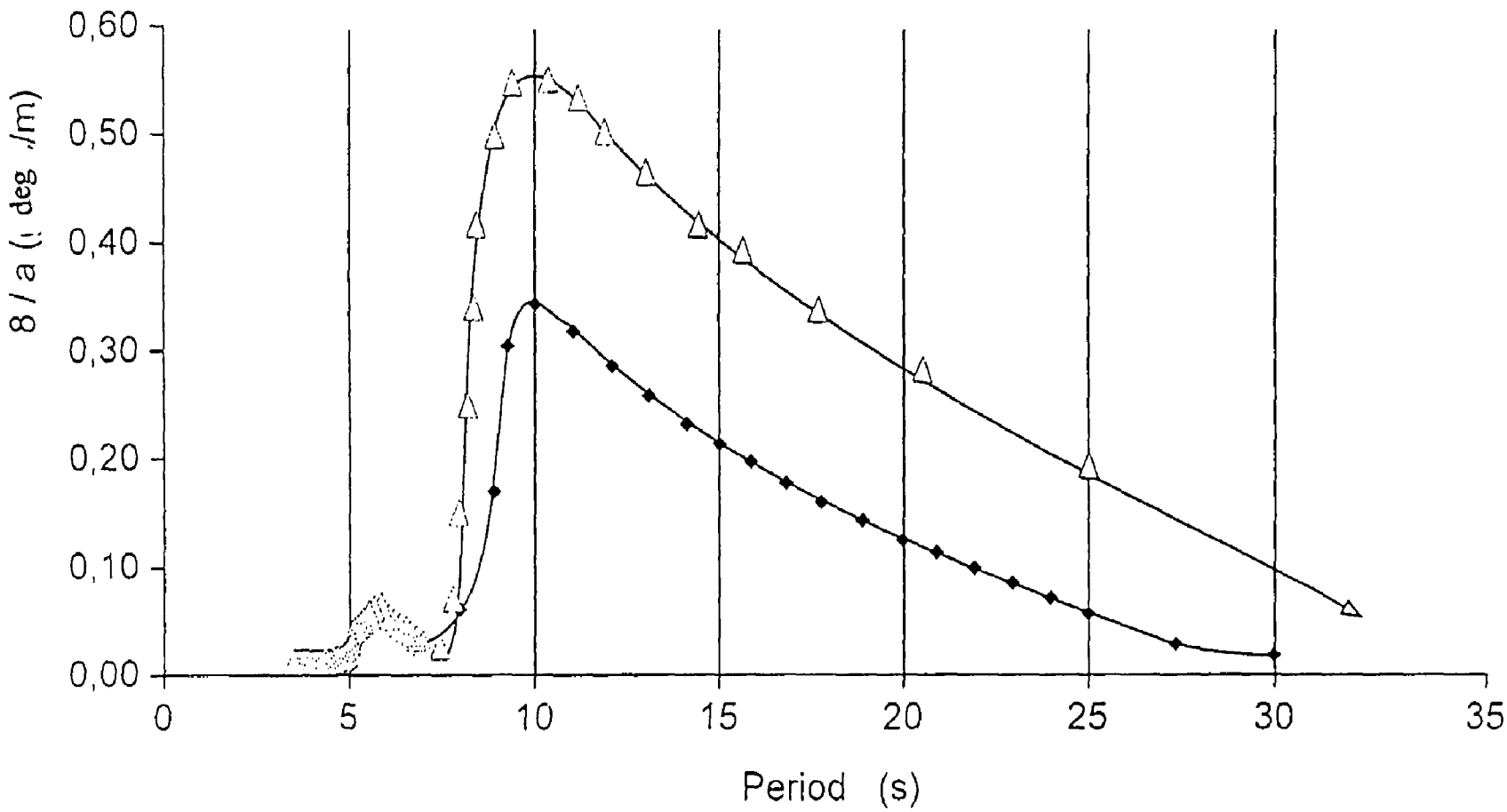
FIG. 4 shows a curve comparing the side-to-side oscillation movement ("roll") of a semi-submersible platform and the floating structure the object of the present invention.

FIG. 4 shows a curve comparing the side-to-side oscillation movement ("roll") of a semi-submersible platform and the floating structure (1) the object of the present invention.

It may be observed in both FIGS. 3 and 4 that in practically all realistic situations, the use of the floating structure (1) object of the present invention provides better performance than the semi-submersible platform.

Thus, as has been shown, the floating structure (1) object of the present invention presents various characteristics that make it extremely adequate for employment as an SPU with low operating costs and high reliability in comparison with the floating structures presently known in the art The use of this invention will allow the extension of the floating production unit concept to a true isle of production the movements of which are minimized so as to allow greater flexibility in the choice of means of receiving and exporting production. Ascending production tubes employed could be flexible or rigid, depending on the necessities of the project.

The invention has been described here in relation to its preferred implementations. It must be mentioned, however, that it is not limited to such implementations. Those with abilities in the art will note that the basic principles of the invention may be applied in various manners other than those described. Thus the invention is only limited to the claims attached to the present report.

The invention claimed is:

1. A floating structure, comprising:

a body, axi-symmetrical in relation to its vertical axis, which includes a lower submersible portion and an upper emergent part, external dimensions of the lower submersible portion being greater than external dimensions of the upper emergent part;

an inclined transition portion that connects the lower submersible portion to the upper emergent part, said floating structure being designed so that said inclined transition portion is located at a waterline;

a lower periphery salience or skirt provided at the lower part of the lower submersible portion;

an internal empty space provided in the interior of the body; the aforesaid internal empty space provides a lower opening in its lower part that has a smaller diameter than the lower part of the internal empty space; and ballast tanks located in a compartmented manner in the lower submersible portion and the upper emergent part;

wherein the aforementioned inclined transition portion causes an alteration in hydrodynamic forces arising from waves that act against the floating structure to absorb the effects of impact of the waves on the floating structure;

wherein the lower periphery salience or skirt restrains a mass of water that is in contact with its surface as the floating structure is moved by the movement of waves and current, so that the aforementioned lower periphery salience or skirt generates a shock-absorbing force opposed to such movements of the floating structure; and wherein, as the floating structure is moved vertically, up and down by the movement of waves and current, the lower opening in the internal empty space tends to create difficulties for the exit or entrance, respectively, of a mass of water from or to the internal empty space, thus generating a shock-absorbing force opposed to such movements of the floating structure.

2. The floating structure in accordance with claim 1, wherein the external perimeter of the lower submersible portion and of the upper emergent part are cylindrical.

3. The floating structure in accordance with claim 1, wherein the external perimeter of the lower submersible portion and of the upper emergent part are polygonal.

4. The floating structure in accordance with claim 1, further comprising a deck located on top of an upper extremity of the upper emergent part, said deck provided with installations necessary for operation of the floating structure as a stationary production and/or drilling unit.

5. The floating structure in accordance with claim 4, wherein anchorage lines are connected to the lower submersible portion.

6. The floating structure in accordance with claim 4, wherein anchorage lines are connected to the upper emergent part.

7. The floating structure in accordance with claim 4, wherein anchorage lines are connected to the lower submersible portion and to the upper emergent part.

* * * * *